US007140942B2

(12) United States Patent
Schueller et al.

(10) Patent No.: US 7,140,942 B2
(45) Date of Patent: Nov. 28, 2006

(54) GATED ELECTRON EMITTER HAVING SUPPORTED GATE

(75) Inventors: Randolph D. Schueller, Austin, TX (US); Charlie C. Hong, deceased, late of Austin, TX (US); by Susan Hong, legal representative, Austin, TX (US)

(73) Assignee: Altera Corporation, San Jose, CA (US)

( * ) Notice: Subject to any disclaimer, the term of this patent is extended or adjusted under 35 U.S.C. 154(b) by 0 days.

(21) Appl. No.: 11/213,597

(22) Filed: Aug. 26, 2005

(65) Prior Publication Data

US 2006/0003662 A1 Jan. 5, 2006

Related U.S. Application Data

(62) Division of application No. 10/035,766, filed on Dec. 26, 2001, now Pat. No. 6,963,160.

(51) Int. Cl.
*H01J 9/02* (2006.01)
*H01J 1/304* (2006.01)

(52) U.S. Cl. ..... 445/50; 445/51; 313/309; 313/310; 313/497

(58) Field of Classification Search ..... 445/46, 445/50–51; 313/309–310, 351, 497; 438/20
See application file for complete search history.

(56) References Cited

U.S. PATENT DOCUMENTS 4,307,507 A * 12/1981 Gray et al. ..... 438/20
4,964,946 A * 10/1990 Gray et al. ..... 216/13
6,066,507 A * 5/2000 Rolfson et al. ..... 438/20
6,514,422 B1 * 2/2003 Huang et al. ..... 216/11

* cited by examiner

*Primary Examiner*—Karabi Guharay
(74) *Attorney, Agent, or Firm*—Martine Penilla & Gencarella, LLP

(57) ABSTRACT

A field emission device having emitter tips and a support layer for a gate electrode is provided. Openings in the support layer and the gate layer are sized to provide mechanical support for the gate electrode. Cavities may be formed and mechanically supported by walls between cavities or columns within a cavity. Dielectric layers having openings of different sizes between the emission tips and the gate electrode can decrease leakage current between emitter tips and the gate layer. The emitter tips may comprise a carbon-based material. The device can be formed using processing operations similar to those used in conventional semiconductor device manufacturing.

13 Claims, 8 Drawing Sheets

GATED ELECTRON EMITTER HAVING SUPPORTED GATE

CROSS-REFERENCE TO RELATED APPLICATIONS

This application is a divisional application of prior U.S. patent application Ser. No. 10/035,766, filed on Dec. 26, 2001, now patented U.S. Pat. No. 6,963,160, entitled GATED ELECTRON EMITTER HAVING SUPPORTED GATE," which is incorporated herein by reference in its entirety for all purposes.

BACKGROUND OF THE INVENTION

This invention relates to a device for field emission of electrons. More particularly, apparatus and method for manufacture are provided for a field emitter having a mechanically supported extraction gate. Field emission is a well-known effect in which electrons are induced to leave a cathode material by a strong electric field. The electric field is formed by a grid or gate electrode in proximity to a tip or protrusion of the cathode material. A common problem with field emission devices fabricated with grids or gates in close proximity to a tip of cathode material is that an electrical short-circuit may develop along the surface of the insulator layer between the gate and the cathode, which can render the device inoperable. To alleviate the problem, field emission devices have utilized multiple layers of insulator material between the cathode and gate or grid to increase the path length along the surfaces between the gate and cathode. U.S. Pat. No. 6,181,060B1 discloses multiple dielectric layers between the grid and cathode that are selectively etched to form a fin of the less etchable dielectric. The fin increases the path length for electrons along the surfaces between the grid and cathode, thus reducing leakage and increasing the breakdown voltage.

Dielectric layers between the gate and cathode have been undercut to produce field emission cathodes having decreased electrical capacitance. Undercutting refers to the process of removing all or most of the material surrounding a majority of the tips, leaving cavities that encompass multiple tips. A problem with cavities is the deflection of the gate layer above the cavity due to electrostatic or mechanical forces. In order to minimize gate deflection over cavities, U.S. Pat. No. 5,589,728 discloses pillars or post supports spaced throughout the cavities that directly support the gate layer but leave the gate layer unsupported between the pillars or posts. Effective gate support with only pillars and such supports reduces overall emission tip density because the pillars are spaced closely and utilize space where tips could otherwise be located. A lower overall emission tip density can require a larger emission device to produce similar electron emission. Such a device may be too large for utilization in products such as CRTs or electron guns.

Accordingly, a need exists for an improved gated electron emitting device. Such device should provide higher current and current density and have longer lifetime than prior art devices. Preferably, the device should be produced inexpensively utilizing conventional semiconductor fabrication processes.

SUMMARY OF THE INVENTION

A gated field emission device with a dielectric support layer that supports the gate electrode over an opening or cavity around one or more emission tips is provided. In one embodiment, multiple layers of dielectric with cavities between the layers and a dielectric support layer that supports the gate electrode are provided. In yet another embodiment, field emission apparatus utilizing support structures such as posts or walls in contact with the support layer are provided. A cover layer of dielectric may be used over the gate layer. Emitter tips may be carbon-based. Methods for making the device using known processing steps are provided.

The foregoing general description and the following detailed description are exemplary and explanatory only and are not restrictive of the invention as claimed.

DESCRIPTION OF THE FIGURES

The present invention is illustrated by way of example and not limitation in the accompanying figures.

Skilled artisans appreciate that elements in the figures are illustrated for simplicity and clarity and have not necessarily been drawn to scale. For example, the dimensions of some of the elements in the figures may be exaggerated relative to other elements to help improve understanding of embodiments of the present invention.

DETAILED DESCRIPTION

Reference is now made in detail to the exemplary embodiments of the invention, examples of which are illustrated in the accompanying drawings. Wherever possible, the same reference numbers will be used throughout the drawings to refer to the same or like parts (elements).

Figure 1:
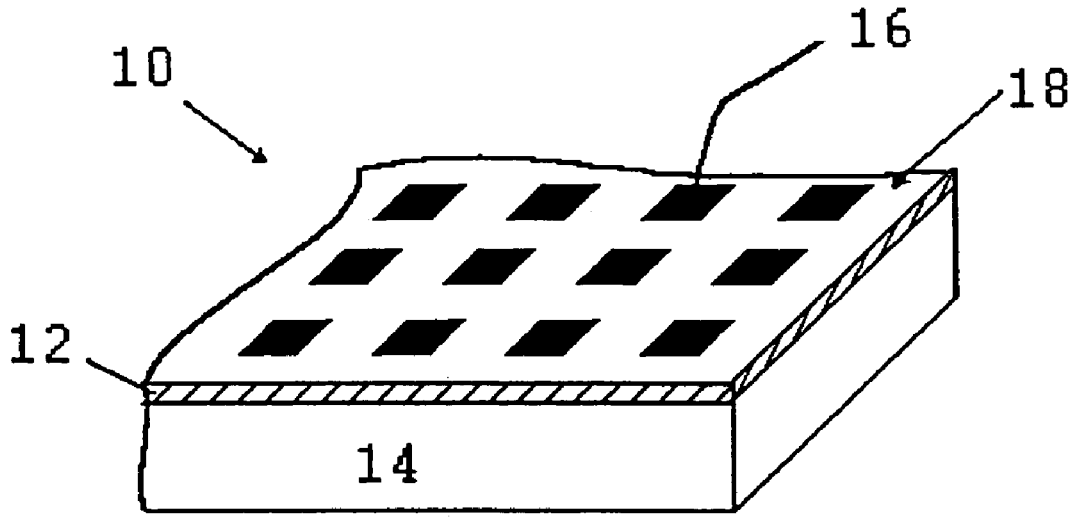
FIG. 1 includes an illustration of a portion of a silicon substrate with a template for forming mold indentions in the silicon.

FIG. 1 illustrates a portion of mold 10 that may be produced using common photolithographic techniques. Initially, thin silicon oxide, silicon nitride, or other similar film 12 can be grown on the surface of silicon wafer 14. A template may be created by etching a plurality of openings 16 in the oxide film using conventional photolithographic processes. The openings may be in the shape of squares or circles. The openings may be in the range of about 2 microns per side and can be arranged in groups such that each group forms an array having a selected number of squares, such as group 18. Mold 10 may consist of a plurality of groups. After the openings are defined in the template, the mold can be anisotropically etched in potassium hydroxide to form indentations or pits in the silicon. The pits may be in the shape of inverted pyramids. The template may be removed using common processes.

Figure 2:
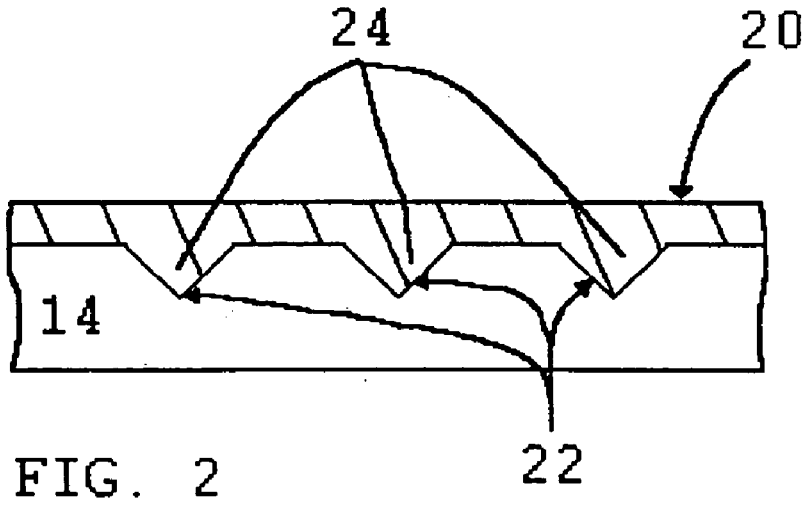
FIG. 2 includes an illustration of a cross-sectional view of a portion of the silicon substrate of FIG. 1 after the template is removed and an emission layer is formed over the silicon substrate and emission tips are formed in mold indentions.

Emission layer 20 may be formed over the mold as shown in FIG. 2. Emission layer 20 may comprise a carbon-based film formed by placing mold 10 in a conventional diamond growth reactor. Common growth conditions may be used to form a carbon-based film, such as disclosed in U.S. Pat. No. 6,181,055B1, which is incorporated by reference herein. Such films may contain a mixture of sp2 and sp3 carbon bonds, and are sometimes referred to as "diamond" and sometimes "carbon-based." The growth of carbon-based material into mold indentions 22 results in tips 24 that can be used as emitters. Other materials having electron-emitting properties may be used. Molded tips 24 can be pyramidal. Emission layer 20 may be grown to a thickness greater than the height of mold indentions 22 to ensure complete formation of tips 24, and generally may have a thickness in the range of approximately 2–5 microns. Emission layer 20 usually will be less than 400 microns thick.

Figure 3:
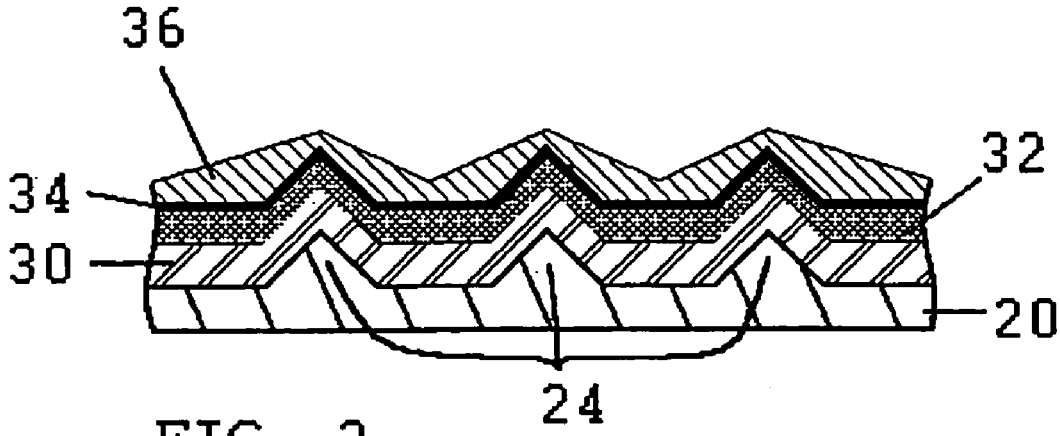
FIG. 3 includes an illustration of a cross-sectional view of a portion of the emission layer with emission tips of FIG. 2 after the mold is removed and a first layer, support layer, gate layer, and photoresist have been formed over the emission layer.

Silicon wafer 14 can be removed from the carbon-based material using well-known techniques, leaving molded carbon-based emitter tips 24 supported by emission layer 20 or other supportive material, as shown in FIG. 3. First dielectric layer 30 may be formed over tips 24 and emission layer 20 using techniques such as sputtering or chemical vapor deposition. Next, dielectric support layer 32 may be formed over first layer 30. First layer 30 may be silicon dioxide ($SiO_2$) or other dielectric material and support layer 32 may be silicon nitride ($Si_3N_4$), a stable form of silicon dioxide, or other dielectric material that allows layer 30 to be selectively etched relative to support layer 32. That is, first layer 30 should be etched at a faster rate than support layer 32 when a selected etchant is used. More than two dielectric layers that etch at different rates with selected etchants may be used. The combined thickness of first layer 30 and support layer 32 may be in the range of approximately 0.5–3microns. First layer 30 and support layer 32 can have a ratio of thickness of approximately one, but may have large deviations from this ratio. The support layer should be thick enough to provide needed mechanical strength for gate layer 34, which generally can be provided when the thickness of support layer 32 is in the range of 0.5–3 micron.

Figure 4:
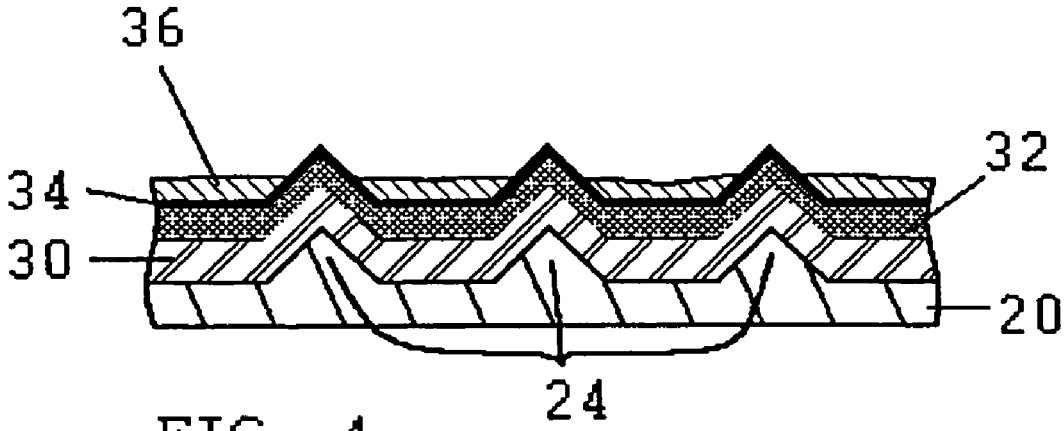
FIG. 4 includes an illustration of a cross-sectional view of a portion of the emission layer with emission tips of FIG. 3 where a portion of the photoresist above the emission tips has been etched to expose a portion of the gate layer.

Still referring to FIG. 3, gate layer 34 may be formed by sputtering or evaporating molybdenum or a similarly conductive and reactive material over support layer 32. Gate layer 34 may have a thickness in the range of approximately 0.1–0.8 microns. Photoresist 36 can be spun onto gate layer 34 such that photoresist 36 over tips 24 is thinner than between tips 24. Next, photoresist 36 may be ion etched with oxygen or another similarly reactive etchant to remove photoresist 36 over tips 24. This etching should expose gate layer 34 over tips 24, as shown in FIG. 4.

Figure 5:
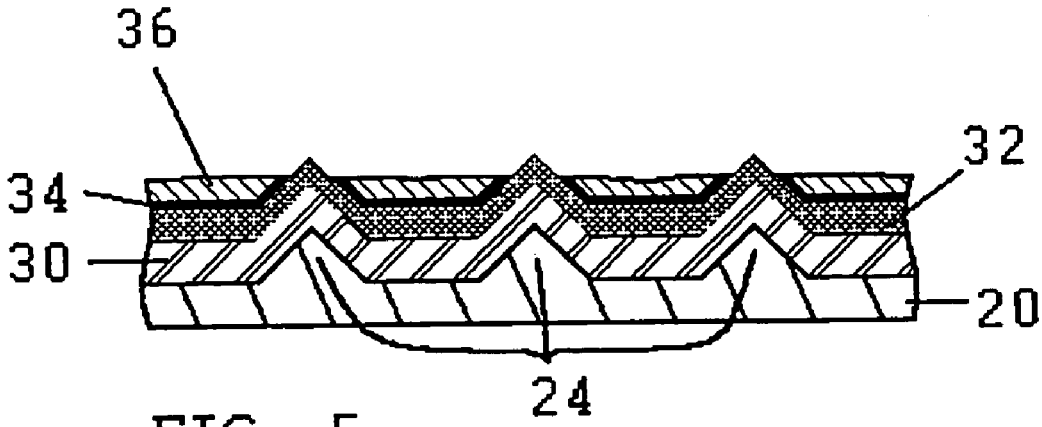
FIG. 5 includes an illustration of a cross-sectional view of a portion of the emission layer with emission tips of FIG. 4 after etching a portion of the gate layer above the emission tips to expose a portion of the support layer.
Figure 6:
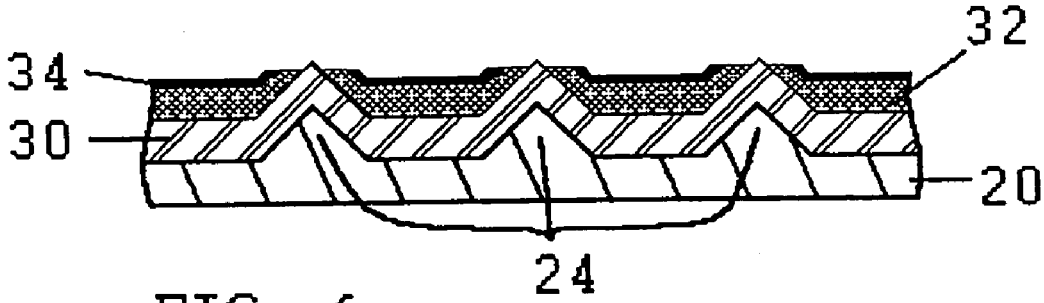
FIG. 6 includes an illustration of a cross-sectional view of a portion of the emission layer with emission tips of FIG. 5 after etching a portion of the support layer above the emission tips to expose a portion of the first layer.

Illustrated in FIG. 5, gate layer 34 may be reactive ion etched with carbon tetrafluoride ($CF_4$), sulfur hexafluoride ($SF_6$), or another similarly reactive chemical to expose support layer 32 over tips 24. Remaining photoresist can be removed using common processes, leaving gate layer 34 exposed as illustrated in FIG. 6. Support layer 32 can be further reactive ion etched to form an opening in layer 32 and to expose first layer 30 through that opening, as shown in FIG. 6. The opening in support layer 32 should be equal in size or smaller than the opening in gate layer 34.

Figure 7:
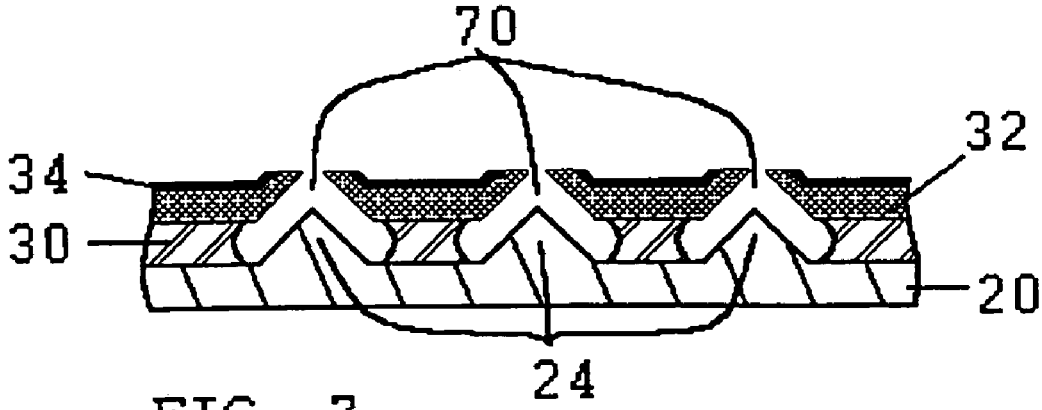
FIG. 7 includes an illustration of a cross-sectional view of a portion of the emission layer with emission tips of FIG. 6 after etching the first layer to form cavities surrounding individual emission tips.

First layer 30 can be wet etched back from tips 24, using a buffered hydrofluoric acid or another similarly reactive etchant. FIG. 7 illustrates the result. Cavity 70 can be formed in first layer 30 around each tip 24. A portion of support layer 32 is left to protect and support gate layer 34. The resulting structure of FIG. 7 increases the surface breakdown path length, mechanically supports gate layer 34 and protects gate layer 34 from evolving tip material. As a result, leakage current between gate layer 34 and emitter tips 24 will be reduced significantly.

Figure 8:
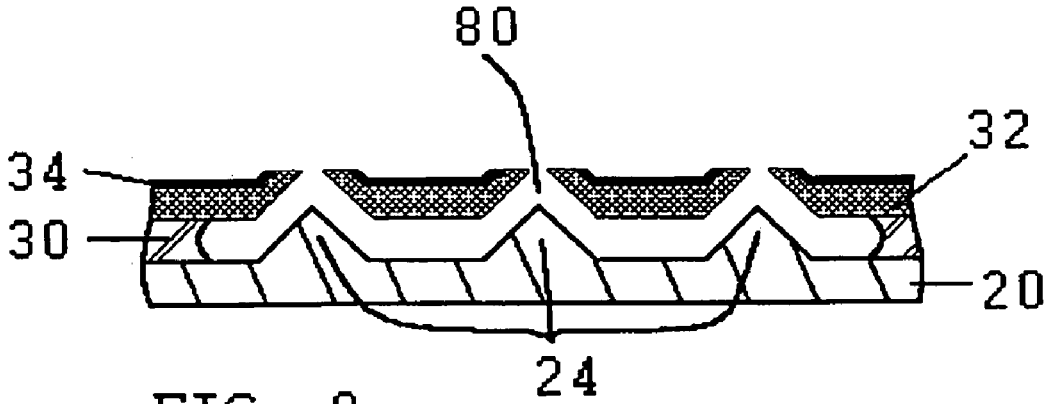
FIG. 8 includes an illustration of a cross-sectional view of a portion of the emission layer with emission tips of FIG. 7 after etching the first layer to form a cavity surrounding multiple emission tips.

In another embodiment, first dielectric layer 30 is completely etched away from most of the tips 24, as illustrated in FIG. 8. This etching step creates cavity 80 around and between multiple tips 24. Support layer 32 is more resistant to the etchant used on first layer 30, such that support layer 32 remains intact and supports gate layer 34.

Figure 9:
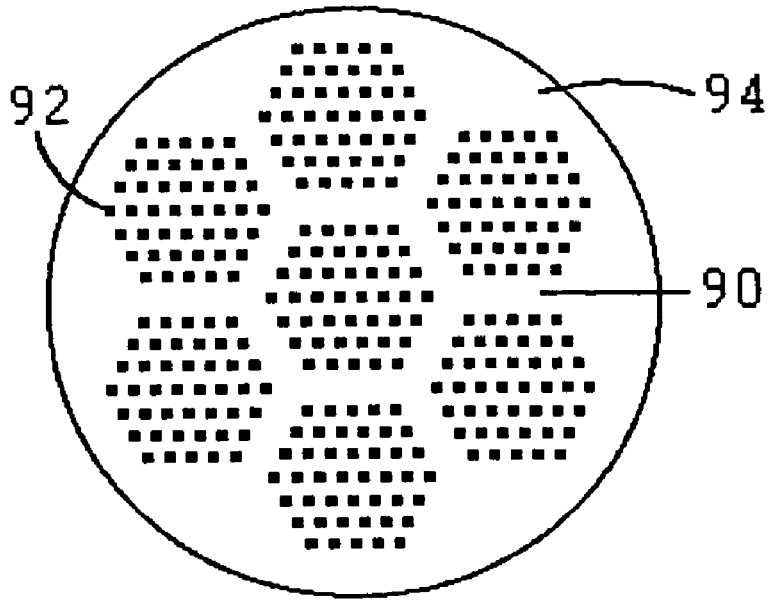
FIG. 9 includes an illustration of a top view of a silicon substrate masked to define support walls and emission tips.
Figure 10:
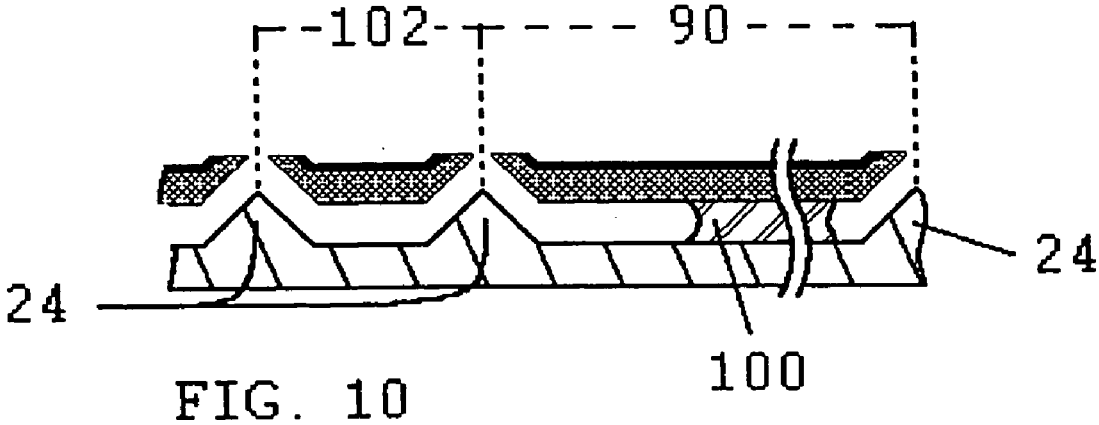
FIG. 10 includes an illustration of a cross-sectional view of a portion of an emission layer with emission tips after the first layer has been etched to define a support wall.

Spaced support structure may be provided for support layer 32 when cavity 80 is large. Dielectric support walls may be formed in an emitter tip array by creating gaps 90 between tip indentions 92 in an initial mold 94, as illustrated in FIG. 9. Gaps 90 and tip indentions 92 may be created in mold 94 using common lithographic techniques. If the gaps are sufficiently wide, for example having a width greater than the tip-to-tip distance 102 (FIG. 10), support wall 100 may remain after layers surrounding the tips are etched as described above. Support wall 100 can be located in the range of 30–70 microns from other support walls or structures, for example. Support walls may be formed in emitter arrays using more than two dielectric layers between an emission layer and a gate layer.

Figure 11:
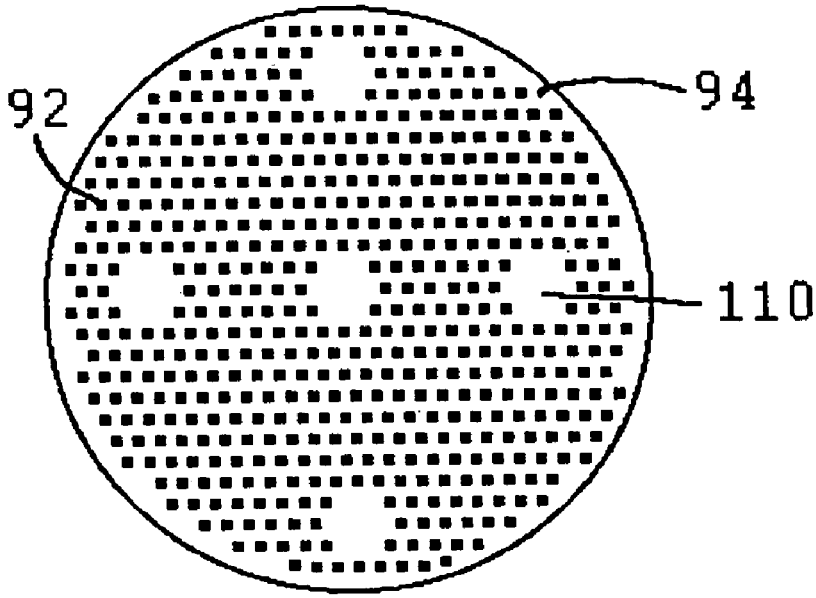
FIG. 11 includes an illustration of a top view of a silicon substrate masked to define support pillars and emission tips.

Alternatively, support pillars can be formed in a final emitter tip array by creating gaps 110 amongst tip indentions 92 in the initial mold 94, as illustrated in FIG. 11. Gaps 110 and tip indentions 92 may be created in mold 94 using common lithographic techniques. If the gaps are sufficiently large, for example having a width greater than the tip-to-tip distance 102, support pillar 110 may remain after layers surrounding the tips are etched as described above. Support pillars can be located 30–70 microns from other supporting pillars or structures, for example. Support pillars may be formed in emitter arrays using multiple dielectric layers between an emission layer and support layer.

Figure 12:
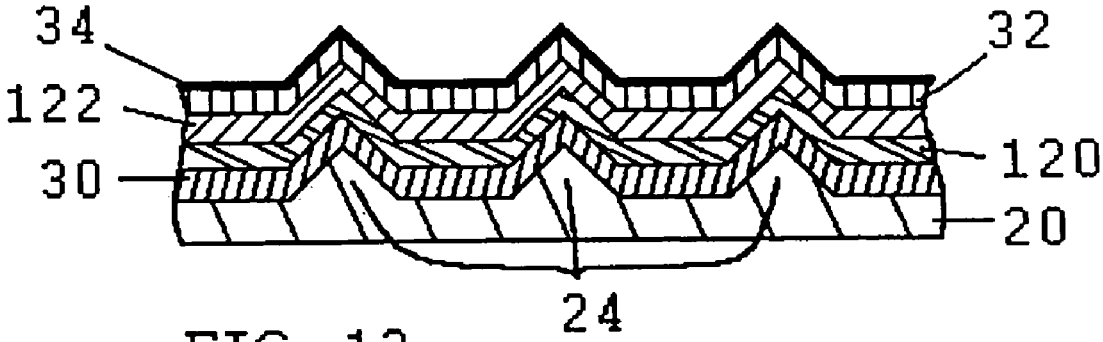
FIG. 12 includes an illustration of a cross-sectional of a portion of an emission layer with emission tips after a first layer, first intermediate layer, second intermediate layer, support layer, and gate layer have been formed over the emission layer and emission tips.

In yet another embodiment, illustrated in FIG. 12, multiple layers may be formed between emission layer 20 and support layer 32. The additional layers can be formed as previously described, utilizing conventional deposition methods such as sputtering or chemical vapor deposition. Additional layers may also be etched to define openings as described above using common etch techniques such as wet etching, dry etching, and reactive ion etching. Methods of forming support structures described earlier may be used with multiple layers located between an emission layer and gate layer.

In a particular embodiment, first etch layer 30, which may be a dielectric or a conductor, as shown in FIG. 12, may be formed over emission layer 20 and tips 24. First etch layer 30 may comprise aluminum or a dielectric etchable material and can be formed through sputter deposition or other common techniques. First intermediate dielectric layer 120 may be formed over first etch layer 30 and may comprise silicon nitride, a stable silicon dioxide, or other dielectric material that is capable of being selectively etched in relation to first etch layer 3O or layers formed later in time. First intermediate dielectric layer 120 may have a thickness in the range from abut 0.1 to about 0.7 micron, for example. Second intermediate dielectric layer 122 can be formed over first intermediate dielectric layer 120 and may comprise silicon dioxide or other dielectric material that is capable of being selectively etched in relation to first etch layer 30, first intermediate dielectric layer 120, or layers formed later in time. The second intermediate dielectric layer may have a thickness in the range from about 0.5 to about 1.5 micron, for example. Support layer 32 is formed over the second intermediate layer and may comprise silicon nitride, a stable silicon dioxide, or other dielectric material that may be selectively etched in relation to first etch layer 30, first intermediate dielectric layer 120, second intermediate dielectric layer 122, or layers formed later in time. First intermediate dielectric layer 120, second intermediate dielectric layer 122, and support layer 32 can be formed through chemical vapor deposition or other conventional methods. Gate layer 34 may be formed over the support layer as described above. Preferably, all of these layers may each have a total thickness in the range of about 0.5–3 micron, but other values of thickness can also be used.

Figure 13:
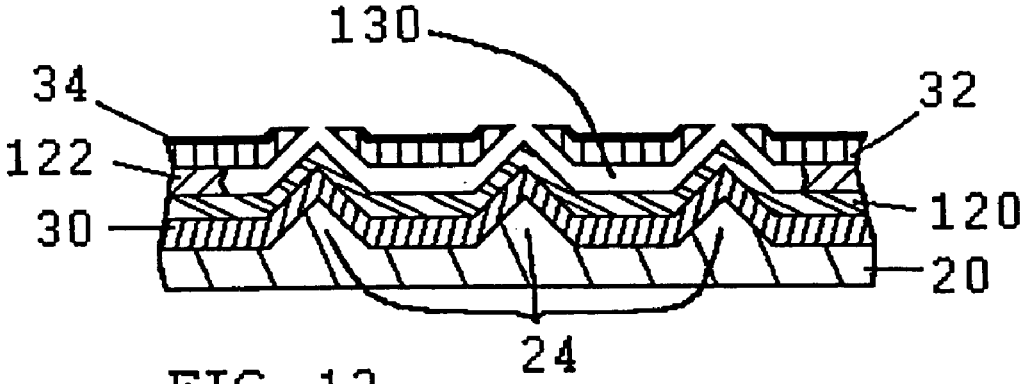
FIG. 13 includes an illustration of a cross-sectional view of a portion of the emission layer with emission tips of FIG. 12 after the gate layer and support layer have been etched to define openings above the emission tips and the second intermediate layer has been etched to define a cavity surrounding multiple emission tips.
Figure 14:
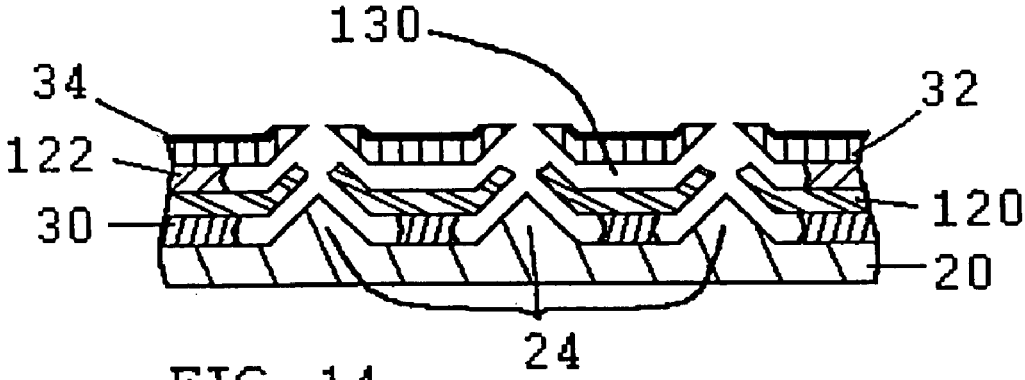
FIG. 14 includes an illustration of a cross-sectional view of a portion of the emission layer with emission tips of FIG. 13 after the first intermediate layer has been etched to define openings above the emission tips and the first layer has been etched to define cavities surrounding individual emission tips.

Photoresist can be applied and gate layer 34 and support layer 30 may be etched as described above to form an opening in layer 32 and to expose second intermediate dielectric layer 122 through that opening. The opening in support layer 32 should be equal in size or smaller in size than the opening in gate 34. A wet etch, such as buffered hydrofluoric acid or another similarly reactive chemical, may then be used to etch second intermediate dielectric layer 122 between support layer 32 and first intermediate dielectric layer 120 to form cavity 130 between support layer 32 and first intermediate layer 120, illustrated in FIG. 13. A reactive ion etch, as described above, can then etch first intermediate layer 120 to expose first etch layer 30. A wet etchant, such as phosphoric acid or another similarly reactive chemical, can be used to remove first etch layer 30 from tips 24 resulting in the structure illustrated in FIG. 14. First etch layer 30 may be etched completely away from most tips 24 to form a cavity (not shown).

Figure 15:
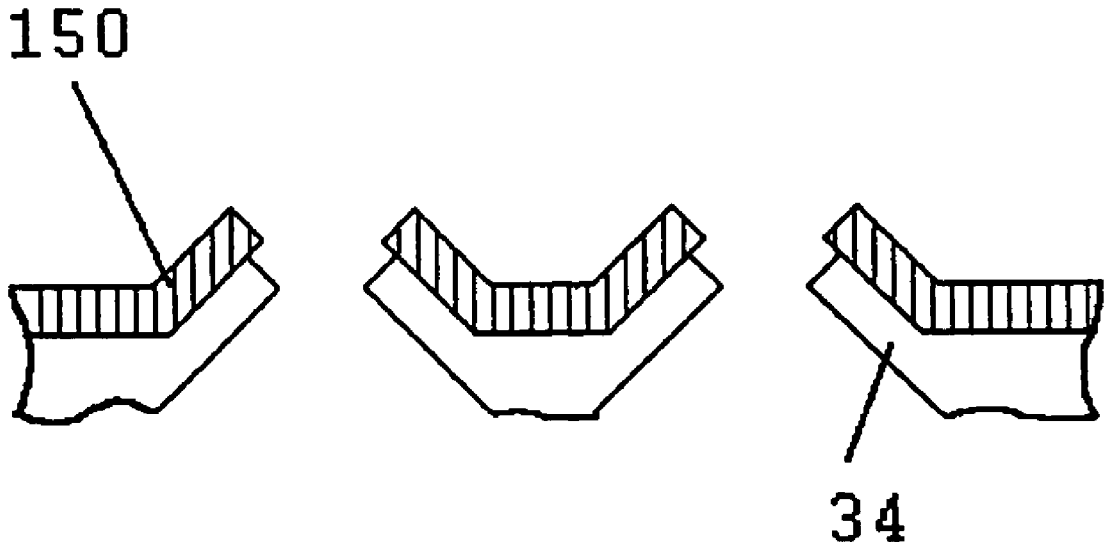
FIG. 15 includes an illustration of a cross-sectional view of a portion of a gate layer after a layer has been formed over the gate layer and openings have been etched in the layer and gate layer.

Another embodiment may include cover layer 150 formed over gate layer 34, illustrated in FIG. 15. Layer 150 may be made of silicon dioxide, silicon nitride, or other dielectric material that may be selectively etched in relation to underlying layers. Layer 150 can be formed using chemical vapor deposition or other conventional methods and may have a thickness in the range from about 0.1 to about 0.9 micron. Layer 150 can provide additional stiffness to gate layer 34 and further protection against electrical shorts. Embodiments incorporating layer 150 may be processed as described above to define openings, cavities, and support structures. Multiple layers may be formed between gate layer 34 and layer 150, or over layer 150 using common processes.

The field emission arrays disclosed herein exhibit more reliable operation and longer lifetimes than field emission arrays of the prior art. Deflection of the gate layer over cavities is eliminated or substantially reduced. The support layer allows fewer supports such as pillars or walls, and thus makes possible greater emission tip density and hence greater emission current density.

In the foregoing specification, the invention has been described with reference to specific embodiments. However, after reading this specification, one of ordinary skill in the art appreciates that various modifications and changes can be made without departing from the scope of the present invention as set forth in the claims below.

The invention claimed is:

1. A method for manufacturing an apparatus for emitting electrons, comprising:

(a) providing a plurality of emitter tips protruding from an emitter material;

(b) depositing a first dielectric layer on the plurality of emitter tips and the emitter material, the first dielectric layer being composed of a dielectric material having an etch reactivity;

(c) depositing a dielectric support layer on the first dielectric layer, wherein the dielectric support layer is composed of a dielectric material having a different etch reactivity than the etch reactivity of the first dielectric layer;

(d) depositing a gate layer on the dielectric support layer;

(e) spinning a photoresist layer on the gate layer and etching the photoresist layer to form an exposed portion of the gate layer over each emitter tip;

(f) etching the exposed portion of the gate layer to form an opening in the gate layer and exposing a portion of the dielectric support layer over the emitter tip;

(g) etching the exposed portion of the dielectric support layer to form an opening in the dielectric support layer and exposing a portion of the first dielectric layer over the emitter tip, the opening in the dielectric support layer being smaller than the opening in the gate layer; and (h) etching the exposed portion of the first dielectric layer to expose one or more emitter tips by forming a cavity having a conical shape around the one or more emitter tips, the cavity defining an opening in the first dielectric layer that is larger than both the opening in the dielectric support layer and the opening in the gate layer.

2. The method of claim 1 wherein the plurality of emitter tips is provided by:

(a) providing a mold having an array of indentations on a selected surface of the mold;

(b) depositing emitter material onto the selected surface of the mold and into the indentations; and (c) removing the mold to expose the plurality of emitter tips.

3. The method of claim 2 wherein the mold further comprises a plurality of arrays of indentations and a flat area on the selected surface interposed between the plurality of arrays.

4. The method of claim 2 wherein the array of indentations encloses a flat area on the selected surface.

5. A method for manufacturing an apparatus for emitting electrons, comprising:

(a) providing a plurality of emitter tips protruding from an emitter material;

(b) depositing a first etch layer on the plurality of emitter tips and the emitter material;

(c) depositing a first intermediate dielectric layer on the first etch layer, the first intermediate dielectric layer having an etch reactivity;

(d) depositing a second intermediate dielectric layer on the first intermediate dielectric layer, wherein the second intermediate dielectric layer is composed of a dielectric material having a different etch reactivity than the etch reactivity of the first intermediate dielectric layer;

(e) depositing a support layer on the second intermediate dielectric layer;

(f) depositing a gate layer on the support layer;

(g) spinning a photoresist layer on the gate layer and etching the photoresist layer to form an opening in the gate layer and exposing a portion of the support layer over each emitter tip;

(h) etching the exposed portion of the support layer to form an opening in the support layer and exposing a portion of the second intermediate dielectric layer over the emitter tip, the opening in the gate layer being larger than the opening in the support layer;

(i) etching the exposed portion of the second intermediate dielectric layer to form a cavity in the second intermediate dielectric layer and an exposed portion of the first intermediate dielectric layer over the emitter tip; cavity in the second intermediate dielectric layer extending over multiple emitter tips;

(j) etching the exposed portion of the first intermediate dielectric layer to form an exposed portion of the first etch layer; and (k) etching the exposed portion of the first etch layer to expose one or more emitter tips.

6. The method of claim 5 wherein the plurality of emitter tips is provided by:

(a) providing a mold having an array of indentions on a selected surface of the mold;

(b) depositing emitter material onto the selected surface of the mold and into the indentions; and (c) removing the mold to expose the plurality of emitter tips.

7. The method of claim 6 wherein the mold further comprises a plurality of arrays of indentions and a flat area on the selected surface interposed between the plurality of arrays.

8. The method of claim 6 wherein the array of indentions encloses a flat area on the selected surface.

9. The method of claim 5 wherein the second intermediate dielectric layer is composed of silicon dioxide.

10. The method of claim 5, wherein the cavity has a conical shape.

11. A method for manufacturing an apparatus for emitting electrons, comprising:

depositing a first dielectric layer over a plurality of conically shaped emitter tips;

depositing a dielectric support layer on the first dielectric layer;

depositing a gate layer on the dielectric support layer;

spinning a photoresist layer on the gate layer and etching the photoresist layer to form an exposed portion of the gate layer over each emitter tip;

etching the exposed portion of the gate layer to form an opening in the gate layer and exposing a portion of the dielectric support layer over the emitter tip;

etching the exposed portion of the dielectric support layer to form an opening in the dielectric support layer and exposing a portion of the first dielectric layer over the emitter tip, the opening in the dielectric support layer being smaller than the opening in the gate layer; and etching the exposed portion of the first dielectric layer to define a cavity around a plurality of emitter tips and wherein the opening in the dielectric support layer is smaller than the base of corresponding emitter tips.

12. The method of claim 11, further comprising:

depositing emitter material into a mold having an array of indentions on a selected surface of the mold; and removing the mold to expose the plurality of conically shaped emitter tips.

13. The method of claim 11 wherein the opening in the dielectric support layer is defined through a vertex of a conically shaped cavity.

* * * * *